US007253696B2

(12) United States Patent
Krowne

(10) Patent No.: US 7,253,696 B2
(45) Date of Patent: Aug. 7, 2007

(54) BI-CRYSTAL HETEROSTRUCTURE ELECTRONIC ISOLATOR

(75) Inventor: Clifford M. Krowne, Alexandria, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 144 days.

(21) Appl. No.: 11/086,732

(22) Filed: Mar. 17, 2005

(65) Prior Publication Data

US 2006/0208822 A1 Sep. 21, 2006

(51) Int. Cl.
*H01P 1/32* (2006.01)
*H01P 1/36* (2006.01)

(52) U.S. Cl. ..... 333/24.2; 333/1.1

(58) Field of Classification Search ..... 333/24.2, 333/1.1

See application file for complete search history.

(56) References Cited

U.S. PATENT DOCUMENTS 6,141,571 A * 10/2000 Dionne ..... 505/210

* cited by examiner

*Primary Examiner*—Stephen E. Jones
(74) *Attorney, Agent, or Firm*—John J. Karasek; L. George Legg

(57) ABSTRACT

A bi-crystal heterostructure includes a first, substantially uniaxial, crystal layer; a second, substantially uniaxial, crystal layer positioned adjacent to the first crystal layer, and wherein the first and second crystal layers have mutually opposite rotations of their respective principal cross-sectional axes of a degree sufficient to impart negative refractivity in the heterostructure; a conductive metal strip positioned between the crystal layers and having a principal longitudinal axis sufficiently aligned with an unrotated principal axis of each of the first and second crystal layers to permit unidirectional electromagnetic wave propagation in the conductive metal strip; and a lossy metal strip positioned between the crystal layers and having a principal axis positioned substantially parallel to the principal axis of the conductive metal strip. Alternatively, one or both of the crystal layers can be replaced with a ferroelectric crystal with an associated static bias voltage source for imparting the uniaxial property to achieve the said crystal layers mutually opposite axes rotations. The conductive metal strip when wired with connectors at each end and positioned in an electrical circuit, e.g. an rf transmitting system, operates as an electrical isolator, substantially blocking signals in one direction while transmitting in the opposite direction.

22 Claims, 13 Drawing Sheets

BI-CRYSTAL HETEROSTRUCTURE ELECTRONIC ISOLATOR

FIELD OF THE INVENTION

This invention relates to a bi-crystal heterostructure having field asymmetric properties. More particularly, the invention relates to a bi-crystal heterostructure electronic isolator.

BACKGROUND OF THE INVENTION

The conventional isolator does its job, if it is a field displacement isolator, by having the incoming field signal sent down the device, being guided by a metallic strip, and leaving the via the right port, with little or no attenuation. Referring now to FIG. 1, a conventional isolator 10 uses as a substrate 12*a* ferrite ceramic material. On a middle surface (not illustrated) of the ferrite substrate is a conductive metal strip (not illustrated), e.g. gold, typically of uniform width and relatively thin compared to the substrate 12 thickness. The conductive strip is what guides the signal, e.g. in the form of microwave energy, through isolator 10. Off to one side of the conductive strip is another strip (not illustrated) typically of a thin material, but unlike the conductive strip it is poorly conductive and very lossy. When the signal is inputted to a right port 14 and exiting on a left port on the side opposite the right port (not illustrated), the electromagnetic field distribution overlaps the lossy strip. The lossy strip is sampled by the signal, and attenuated, and as the energy flows through the device, it gets absorbed increasingly, so that as it approaches the left port 16, almost no signal amplitude remains. The electromagnetic field distribution is asymmetric, and that is why when the signal flows in the opposite direction, the fields do not see the lossy strip. Conventional isolators are described in F. J. Rosenbaum, Integrated Ferrimagnetic Devices, in *Advances in Microwaves* 8, 203 (Academic Press, New, 1974). J. D. Adam et al., IEEE Trans. Microwave Th. & Tech. 50, 721 (2002). M. E. Hines, IEEE Trans. Microwave Th. & Tech. 19, 442 (1971). F. N. Bradley, *Materials for Magnetic Functions* (Hayden, N.Y. 1971). P. J. B. Clarricoats, *Microwave Ferrites* (Wiley, N.Y., 1961). R. F. Soohoo, *Theory & Applications of Ferrites* (Prentice-Hall, N.J., 1960). To summarize these references regarding the bias field, for principal axis static bias $H_0$ field, asymmetry occurs in a direction normal to $H_0$ and propagation direction $k_p$. Edge guided microstrip isolator uses $H_0\hat{x}$, earlier waveguide structure used $H_0\hat{y}$.

Although conventional ferrite isolators work well, and are widely used in the various frequency bands throughout the microwave and millimeter wavelength regions, there are several severe drawbacks. One—they must employ static bias magnetic fields on the order of several thousand gauss (many tesla). To make these fields requires the use of either large magnets or large coils with circulating current, which are substantially larger than the other circuit elements and the device itself that actually propagates, controls and directs the signals. Two—both magnets and coil arrangements require what are termed magnetic circuits to direct the magnetic bias fields flow where desired in order to apply a static bias field to the ferrite material. This is because the effective action of the ferrite occurs when an external magnetic field lines up the precessing magnetic spin moments associated with the magnetic atoms in the ceramic material. Such isolator devices therefore rely on the spin precession effect found in ceramic ferrites. Three—the biasing magnets or coils add substantial additional weight and size to the device in the overall structure of conventional isolators. Magnetic circuits also add a substantial amount of weight and size. Four—finally, a substantial part of the cost of a conventional isolator is from the high quality low loss ferrite material, the entire magnetic circuit, and the magnets or coils.

There is, therefore, a need for an electronic isolator that is smaller and less expensive than existing conventional devices.

SUMMARY OF THE INVENTION

According to the invention, a bi-crystal heterostructure includes a first, substantially uniaxial, crystal layer; a second, substantially uniaxial, crystal layer positioned adjacent to the first crystal layer, and wherein the first and second crystal layers have mutually opposite rotations of their respective principal cross-sectional axes of a degree sufficient to impart negative refractivity in the heterostructure; a conductive metal strip positioned between the crystal layers and having a principal longitudinal axis sufficiently aligned with an unrotated principal axis of each of the first and second crystal layers to permit unidirectional electromagnetic wave propagation in the conductive metal strip; and a lossy metal strip positioned between the crystal layers and having a principal axis positioned substantially parallel to the principal axis of the conductive metal strip. Alternatively, one or both of the crystal layers can be replaced with a ferroelectric crystal with an associated static bias voltage source for imparting the uniaxial property to achieve the said crystal layers mutually opposite axes rotations. The conductive metal strip when wired with connectors at each end and positioned in an electrical circuit, e.g. an rf transmitting system, operates as an electrical isolator, substantially blocking signals in one direction while transmitting in the opposite direction.

The present invention that utilizes dielectric crystals addresses the disadvantages of the conventional devices noted above. For the fixed bicrystal isolator, no static magnetic fields are required. After all, the material is non-magnetic and so magnets or coils are not needed. Of course, the circuits for the biasing are not needed also. The elimination of the magnets/coils and associated circuits gets rid of all of that extra weight (and volume), with the resulting device being much lighter and smaller.

If one desires to have a variable bicrystal isolator, then using a material like a ferroelectric which can have its permittivity altered by static electric field biasing, will necessitate a voltage biasing circuit. Such circuits are orders of magnitude lighter and smaller than magnetic biasing circuits. Also, they do not require the equivalent of a magnet, because the static field is created by the potential between two metal plates, which can be vanishing thin and thereby extremely small and light weight. Of course, there is the need for a dc power supply, but this may already be available for other electronic functions in the system.

Additional features and advantages of the present invention will be set forth in, or be apparent from, the detailed description of preferred embodiments which follows.

DETAILED DESCRIPTION OF THE PREFERRED EMBODIMENTS

DEFINITIONS: As used herein, the following definitions apply: The term "right-handed medium" (RHM) means that the power flow and the phase propagation constant are in the same direction. The term "left-handed medium" (LHM) means that the power flow and the phase propagation constant are in the opposite direction. "Unidirectional electromagnetic wave propagation" means there is principally propagation in one direction. A uniaxial crystal is a crystal which has two of the three principal axis elements the same, and one different from the other two elements. A bi-crystal is an arrangement of two crystals which are adjacent to one another. The two crystals may have different the same chemical composition. For the invention here, they have the same composition, but different rotations applied to them, with respect to one another.

A uniaxial bi-crystal (BC), more correctly referred to as a bi-crystal made up of two uniaxial crystals, can exhibit at certain frequencies and for some materials and conditions negative refraction (which is also total), that is, exit rays present bending opposite with respect to the normal compared to an ordinary right-handed medium (RHM) for certain incidence angles. Negative refractive (NR) property also occurs for a left-handed medium (LHM), and when its absolute values of constitutive constants are identical to those of the right-handed medium (RHM), it also shows total refraction. In general, what is shared here between the bi-crystal and the LHM is the negative refractive property. NR property in the bi-crystal arises from broken crystalline symmetry, and allowed the interesting physics summarized above to be displayed. Rays being traced are power flow lines in the optics case, and as described in "Total Negative Refraction in Real Crystals for Ballistic Electrons and Light", Y. Zhang, B. Fluegel and A. Mascarenhas, Phys. Rev. Lett. 91, 157404 (2003) (hereinafter Zhang et al.), has an analog, of ballistic electron motion in a semiconductor heterostructure.

Very unusual field distributions have been discovered in guided wave LHM structures, as described in "Physics of Propagation in Left-Handed Guided Wave Structures at Microwave and Millimeter-Wave Frequencies", C. M. Krowne, Phys. Rev. Lett. 92, 053901 (2004), with counter intuitive field line direction and circulation patterns. Broken crystal symmetry in a bi-crystal not only produces NR, but breaks field symmetry, allowing asymmetric distributions of electromagnetic fields in the cross-section in which heterostructure layering occurs when guided wave propagation is perpendicular to this cross-section in a longitudinal direction. Individual heterostructure layers are not field symmetry breaking and do not lead to asymmetric field distributions. In fact, when a single crystal is inserted into a guiding structure, nothing special happens.

Figure 1:
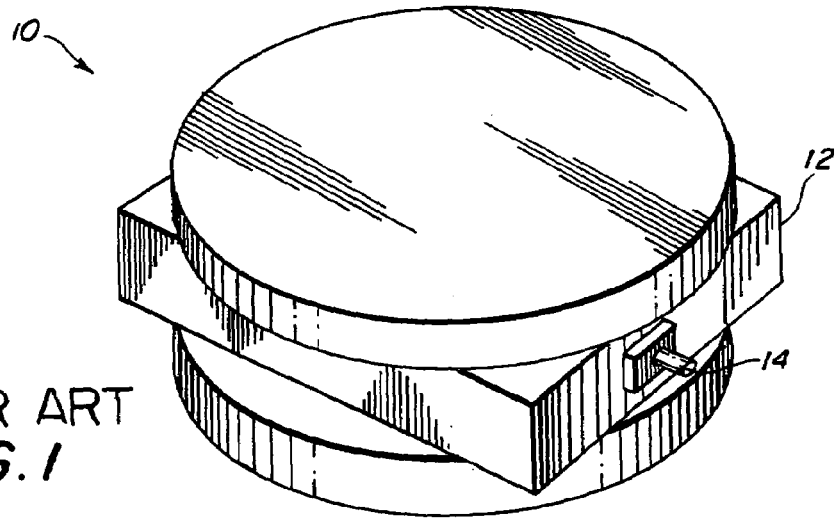
PRIOR ART FIG. 1
FIG. 1 is a perspective diagram of a prior art electrical isolator.
Figure 2:
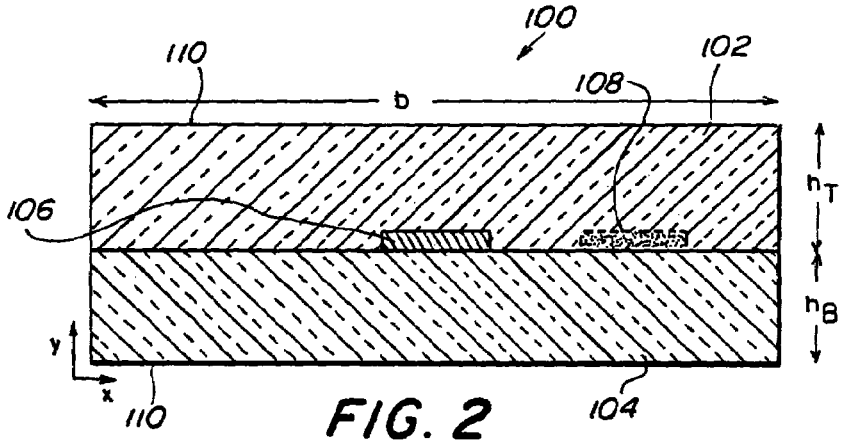
FIG. 2 is a schematic cross-sectional diagram of a bi-crystal heterostructure according to the invention.
Figure 3:
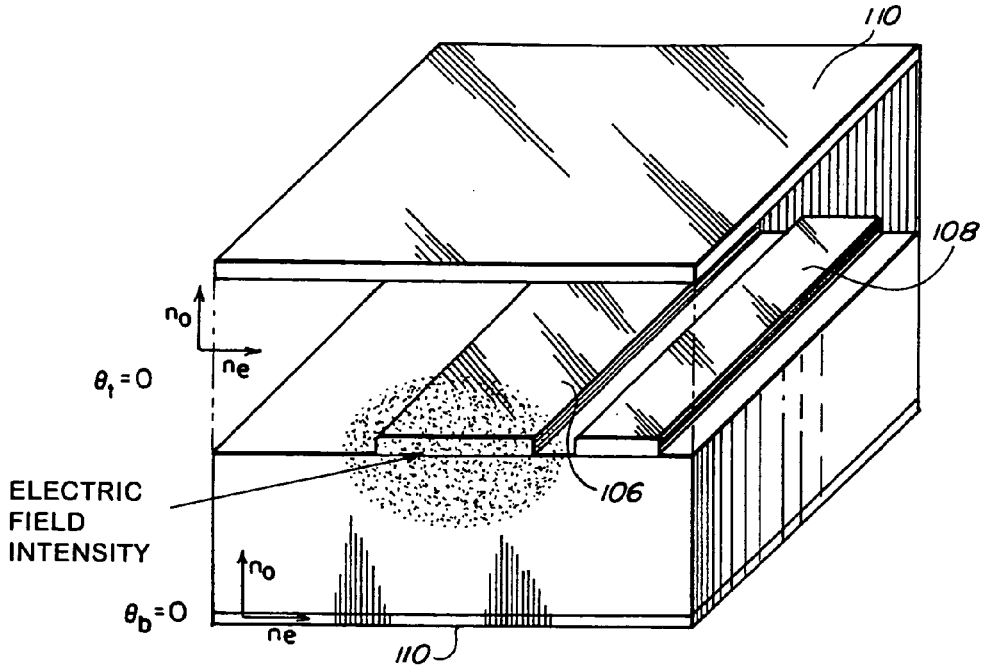
FIG. 3 is a schematic cross-sectional diagram of a comparative bi-crystal heterostructure without the required axial rotation of the crystals.
Figure 4:
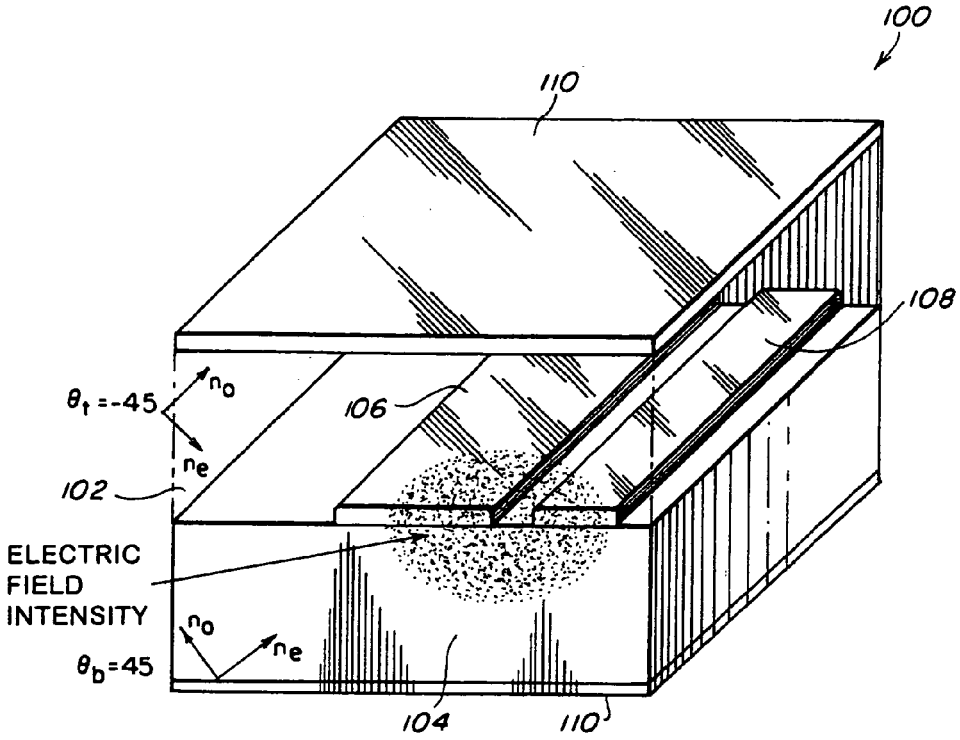
FIG. 4 is a schematic cross-sectional diagram of a bi-crystal heterostructure with the required axial rotation of the crystals according to the invention.

The present invention, however, employs a bi-crystal stripline structure that in guiding a wave creates asymmetric rf electric and magnetic field distributions. Referring now to FIG. 2, a bi-crystal heterostructure 100 includes two uniaxial crystal layers 102 and 104 with a guiding conductive metal strip 106 inserted there between, causing fundamental mode propagation. A lossy strip 108 is positioned alongside conductive strip 106 and its function is described below. Top and bottom ground planes 110 may be fabricated from any compatible insulator material. FIGS. 3 and 4 respectively show a comparative structure (FIG. 3), with unrotated uniaxial crystals where neither crystal has any rotations applied to the principal axis systems of the individual crystals, and FIG. 4 shows the structure described above in regard to FIG. 100 with the rotated crystals (see FIG. 4) shown. Suitable bi-crystal arrangements utilizing the uniaxial property (i.e. broken crystal symmetry property) include $LiNbO_3$ (microwave frequenscies), $YVO_4$ (optical frequencies), and any other crystal with substantial birefrigence.

Crystal tensor permittivities for layers 104 and 102 respectively (where 104 is the bottom ("b") and 102 the top ("t") are $$\bar{\varepsilon}_{b,t} = \begin{bmatrix} \varepsilon_{xx} & 0 & 0 \\ 0 & \varepsilon_{yy} & 0 \\ 0 & 0 & \varepsilon_{zz} \end{bmatrix} \tag{1}$$

in their principal axis systems, where two of the diagonal elements are the same. When they are rotated in the transverse xy plane normal to the z-axis, as described in "Theoretical Considerations for Finding Anisotropic Permittivity in Layered Ferroelectric/Ferromagnetic Structures from Full-Wave Electromagnetic Simulations.", C. M. Krowne, *Microwave & Optical Tech. Lett.* 28, 63–69 (2001), the unitary matrix $L(\phi;z)$ must have $\phi \rightarrow 90Þ- -\phi$ to have strictly the same rotation sense about the x and y axes. Then the new rotated permittivity tensor is $\bar{\epsilon}'=\overline{L\epsilon L}^T$ where elements of $\overline{L}$ are $L_{xx}=-L_{yy}=-\cos\theta$, and $L_{xy}=L_{yx}=\sin\theta$, where $\theta$ is exchanged for $\phi$ to agree with notation in (2), and there is no zy-element $$\bar{\bar{\varepsilon}}_{b,t} = \begin{bmatrix} [\varepsilon_{xx}\cos^2\theta_{b,t} + \varepsilon_{yy}\sin^2\theta_{b,t}] & [\varepsilon_{yy} - \varepsilon_{xx}](\sin 2\theta_{b,t})/2 & 0 \\ [\varepsilon_{yy} - \varepsilon_{xx}](\sin 2\theta_{b,t})/2 & [\varepsilon_{xx}\sin^2\theta_{b,t} + \varepsilon_{yy}\cos^2\theta_{b,t}] & 0 \\ 0 & 0 & \varepsilon_{zz} \end{bmatrix} \quad (2)$$

Rotation angle θ of the principal axes about the z-axis is counter-clockwise for a positive angle. For a single layer of crystal, looking in the x principal axis direction appears the same as in the reverse direction. This is basically because marking off atomic layers in the +x direction looks the same as marking them off in the −x direction. However, when two crystals lie adjacent to each other, this is no longer generally true, since marking off atomic layers in the principal axis system of the bottom crystal, say in the $x_b$ direction, will not mark off successive atomic layers in the $x_t$ principal axis direction of the top crystal. The symmetry is broken.

One notices that the off—diagonal elements of $\bar{\bar{\epsilon}}$ are maximized in the individual crystal layers when sin 2θ=1. This occurs for θ=±45°. Choosing $\theta_b$=+45° and $\theta_t$=−45° allows both top and bottom crystals to have maximum off—diagonal elements. $\Delta\theta=\theta_b-\theta_t=90°$ in this case. θ=0° corresponds to the unrotated situation in (1) giving $\Delta\theta=\theta_b-\theta_t=0°$. θ=±90°, setting $\theta_b$=+90° and $\theta_t$=−90° makes $\Delta\theta=\theta_b-\theta_t=180°$. This last assignment causes the incommensurate marking off of atomic layers to vanish, making symmetry appear again (looks like the unrotated case again).

There are only two possibilities for (1) being a uniaxial tensor in the initial unrotated principal axes system. Dyadic tensors must be either $$\bar{\bar{\varepsilon}}^1_{b,t} = \begin{bmatrix} \varepsilon_e & 0 & 0 \\ 0 & \varepsilon_o & 0 \\ 0 & 0 & \varepsilon_o \end{bmatrix} \text{ or } \bar{\bar{\varepsilon}}^2_{b,t} = \begin{bmatrix} \varepsilon_o & 0 & 0 \\ 0 & \varepsilon_e & 0 \\ 0 & 0 & \varepsilon_o \end{bmatrix} \quad (3)$$

because there are only two ways to insert the single extraordinary axis permittivity into the 2×2 submatrix, also forcing the last $\hat{z}\hat{z}$ diagonal dyadic element to be the ordinary value.

If θ=±45° is chosen, with $\theta_b$ and $\theta_t$ as above, then $\sin^2\theta=\cos^2\theta=½$, making the diagonal dyadic elements from (2) become $$\varepsilon_{rxx} = \varepsilon_{ryy} = \frac{\varepsilon_{xx} + \varepsilon_{yy}}{2} \Rightarrow \varepsilon_a = \frac{\varepsilon_e + \varepsilon_o}{2} \quad (4)$$

an averaged value of the first two principal axis diagonal dyadic elements. Off—diagonal dyadic elements from (2) become $$\varepsilon_{rxy} = \varepsilon_{ryx} = \frac{\varepsilon_{yy} - \varepsilon_{xx}}{2} \Rightarrow \varepsilon_{d1} = \frac{\varepsilon_o - \varepsilon_e}{2}, \varepsilon_{d2} = \frac{\varepsilon_e - \varepsilon_o}{2} \quad (5)$$

depending on whether the first $\bar{\bar{\epsilon}}_{b,t}{}^1$ or second $\bar{\bar{\epsilon}}_{b,t}{}^2$ dyadic is selected in (3). Positive crystal as described in J. F. Nye, *Physical Properties of Crystals* (Oxford Univ. Press, Oxford, UK, 1979), is defined as having $\epsilon_e-\epsilon_o>0$ makes $\epsilon_{d1}<0$, and a negative crystal with $\epsilon_e-\epsilon_o<0$ makes $\epsilon_{d1}>0$. Exactly the reverse happens for the second dyadic tensor, namely, $\epsilon_e-\epsilon_o>0$ makes $\epsilon_{d2}>0$, and $\epsilon_e-\epsilon_o<0$ makes $\epsilon_{d2}<0$.

Once the crystalline physics has been determined as above, then the physics based spectral domain method as described in "Fourier Transformed Matrix Method of Finding Propagation Characteristics of Complex Anisotropic Layered Media", C. M. Krowne, IEEE Trans. Microwave Th. Tech. 32, 1617–1625 (1984), may be used to specify the Green's function system matrix R which gives the tangential transverse field component variation (column vector N) perpendicular to the heterostructure bilayers in the y-direction.

$$\frac{d\aleph}{dy} = i\omega R\aleph; \quad \aleph = [E_x \quad E_z \quad H_x \quad H_z]^T \quad (6)$$

Auxiliary equations give the two remaining field components, $E_y$ and $H_y$, R is a 4×4 matrix, and its elements are given by $$r_{11} = -\frac{\varepsilon_{yx}}{\varepsilon_{yy}}\frac{k_x}{\omega}, r_{12} = 0, r_{13} = \frac{1}{\varepsilon_{yy}}\frac{i\gamma k_x}{\omega^2}, r_{14} = \mu - \frac{1}{\varepsilon_{yy}}\frac{k_x^2}{\omega^2} \quad (7a)$$

$$r_{21} = -\frac{i\gamma}{\omega}\frac{\varepsilon_{yx}}{\varepsilon_{yy}}, r_{22} = 0, r_{23} = -\mu - \frac{1}{\varepsilon_{yy}}\frac{\gamma^2}{\omega^2}, r_{24} = -\frac{1}{\varepsilon_{yy}}\frac{ik_x\gamma}{\omega^2} \quad (7b)$$

$$r_{31} = -\frac{1}{\mu}\frac{i\gamma k_x}{\omega^2}, r_{32} = -\varepsilon_{zz} + \frac{1}{\mu}\frac{k_x^2}{\omega^2}, r_{33} = 0, r_{34} = 0 \quad (7c)$$

$$r_{41} = \varepsilon_{xx} - \frac{\varepsilon_{xy}\varepsilon_{yx}}{\varepsilon_{yy}} + \frac{1}{\mu}\frac{\gamma^2}{\omega^2}, r_{12} = \frac{1}{\mu}\frac{ik_x\gamma}{\omega^2}, \quad (7d)$$

$$r_{13} = \frac{i\gamma}{\omega}\frac{\varepsilon_{xy}}{\varepsilon_{yy}}, r_{14} = -\frac{k_x}{\omega}\frac{\varepsilon_{xy}}{\varepsilon_{yy}}$$

when $\bar{\bar{\epsilon}}$ is uniaxial [elements are rotated (2) values given in (4) and (5)], $\bar{\bar{\mu}}$ is isotropic, and the optical activity tensors $\bar{\bar{\rho}}$ and $\bar{\bar{\rho}}'$ are null for the problem being treated here.

Figure 5:
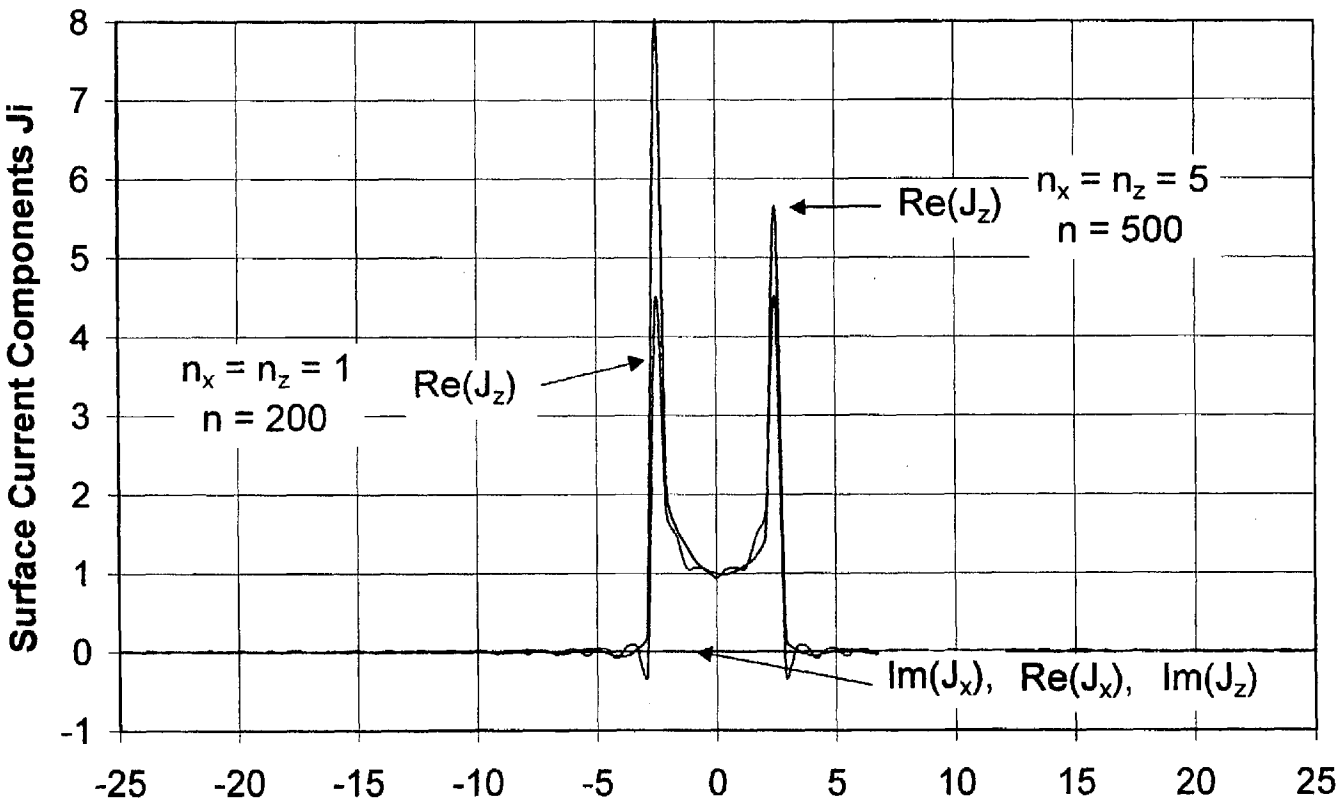
FIG. 5 is a graph showing the current distribution along the x axis of the comparative heterostructure of FIG. 3 and the rotated crystal structure of FIG. 4.

When no rotations are applied to the tensor $\bar{\bar{\epsilon}}$ in (1), θ=0° and the two separate crystals exhibit behavior as a uniform slab, with an insert of an infinitely thin, perfectly conducting metal guiding strip (see FIG. 2). In this case one would not expect the current distribution $J_z$ along the x-axis to have any asymmetry, as is shown in FIG. 5. All the calculations herein are run at 10 GHz unless otherwise noted, although the invention is not limited to this frequency, which is used for illustrative purposes only. Since small signal solutions are found, only relative values of J are E are important. In simulations, dimensions of the structure shown in FIG. 2 were chosen to be $w=h_B=h_T$=5 mm, b=50 mm, making b/w=10. The permittivity tensor was chosen to be the first type $\bar{\bar{\epsilon}}_{b,t}{}^1$ for a negative crystal with $\epsilon_e$=4.5 and $\epsilon_o$=5.5. Nominal permittivity is 5 ($\epsilon_a$=5) and this value was selected to be about the same as the nominal value of the $YVO_4$ positive crystal in Zhang et al. with $n_e$=2.25081 and $n_o$=2.01768 giving $\epsilon_e$=5.06615 and $\epsilon_o$=4.07103. The θ=0° curve shown for $J_z$ phasor (complex) component was found by using an equal number of even and odd parity current basis functions $n_x=n_z$=1 for the currents $J_x$ and $J_z$ in the x and z directions. Number of spectral (Fourier) terms n=200 (see the orange curve in FIG. 5 for Re($J_z$)). The same result is obtained using only even parity current basis functions, since the fundamental mode studied here is a symmetric mode. The use of more current basis functions $n_x=n_z$=1 produces the same shaped curve. Large b/w ratio employed here was done to make almost all of the electromagnetic energy exist in the region around the guiding strip, allowing the vertical side walls (which are perfect conductors) to act as computational boundaries for the numerical solution. Because the electromagnetic fields to be described next were constructed by taking the real part of the phasors (i.e., $E_{plot}=|\mathrm{Re}E|$), to obtain physical quantities, the same operation pertains, of course, to the surface current.

Figure 6:
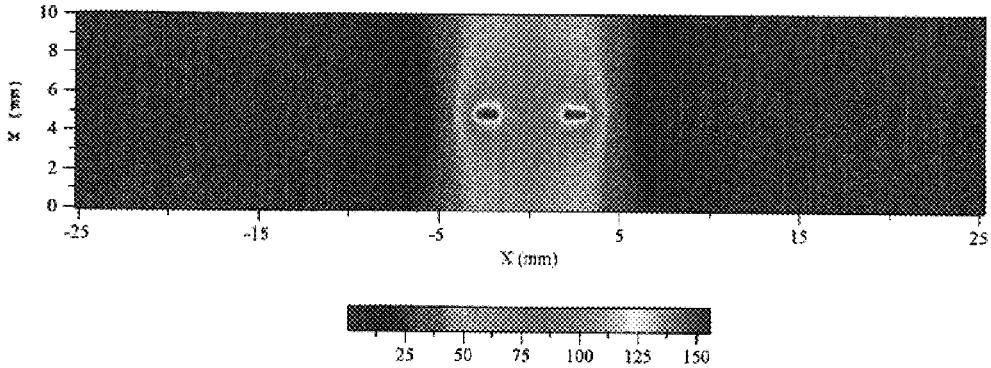
FIG. 6 shows the electric field magnitude distribution of the comparative heterostructure of FIG. 3.
Figure 7:
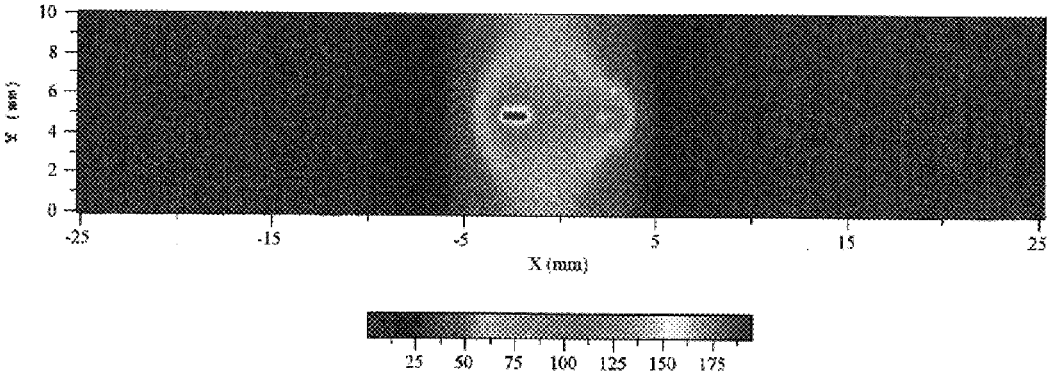
FIG. 7 shows the electric field magnitude distribution of the heterostructure of FIG. 4 according to the invention.

Electromagnetic field distribution E for the magnitude of the rf electric field E is displayed in FIG. 6 for the θ=0° unrotated case. Electric rf field distribution E is symmetric, extending between the bottom and top ground planes (which act as perfect conductors). Highest field intensity of E is at the strip edges, with an elliptic region of somewhat lower intensity surrounding the entire strip. FIG. 7 shows the rotated case of θ=±45° with $$\bar{\bar{\varepsilon}}(\theta=\pm 45^\circ)=\begin{bmatrix} 5 & \pm 0.5 & 0 \\ \pm 0.5 & 5 & 0 \\ 0 & 0 & 5.5 \end{bmatrix} \tag{8}$$

Figure 8:
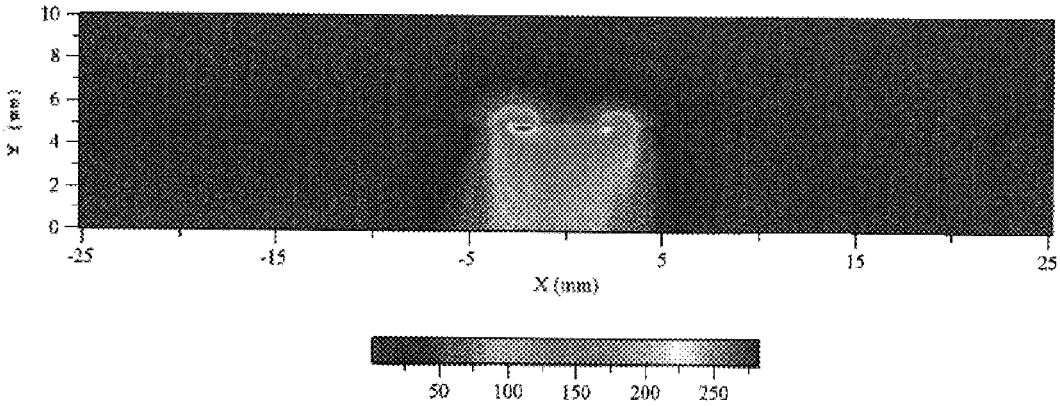
FIG. 8 shows the comparative electric field distribution of a heterostructure as in FIGS. 2 and 4 but with the top crystal layer removed and replaced by an air layer to demonstrate the lack of broken symmetry in the absence of the bi-crystal layer configuration.

Clearly, the electric field distribution E is asymmetric, having shifted in a comet shaped pattern to the left. FIG. 5 shows the $J_z$ current distribution (see the green curve in the figure for $\mathrm{Re}(J_z)$) for this rotated case with $n_x=n_z=5$ and n=500 ($n_x=n_z=1$ and n=200 gave nearly the same curve shape, with almost the same ratio of the left and right peak currents at the strip edges). As further substantiation that the broken symmetry effect requires the paired heterostructure of the bi-crystal, FIG. 8 shows the field distribution for E when the structure is converted into a microstrip configuration by extirpating crystal layer 102 from the top, leaving only air. Crystal layer 104 still has the $\theta_b$=+45° rotation. Using $n_x=n_z=1$ and n=200, and either even or both even and odd symmetry current basis functions, the same basically symmetric distribution is observed (slight distortion seen is an artifact of post processing). This indicates that a single crystal material or single layer will not produce the broken symmetry effect generating asymmetric field distributions.

Referring again to FIG. 4, the shifting of the electric field distribution in the direction of lossy strip 108 results in the absorption of the electric field energy in the lossy material, which significantly attenuates signal propagation in the z direction. It is also evident that in the −z direction, the shifting in electric field distribution is away from the lossy strip, allowing propagation of signals and providing the unidirectional propagation property of heterostructure 100. FIG. 3 illustrates the absence of this effect in isotropic crystal materials.

These calculations are done using an ab initio approach with an anisotropic Green's function which allows the physical properties of the uniaxial crystals to be treated through their tensors. The results have very important implications for microwave transmission devices which rely on asymmetric field distributions. In principal, there is no reason why this can not be extended to optical waveguides used at millimeter wavelengths, or even higher frequencies up to the optical. All electric nonreciprocal devices are possible, in analogy to what g-tensors could do in semiconductor heterostructures for electron spin control where the elimination of the external control magnetic field could allow all electric gating (e.g. see "Universal Quantum Computation with Spin-½ Pairs and Heisenberg Exchange", J. Levy, Phys. Rev. Lett. 89, 147902 (2002); "Gigahertz Electron Spin Manipulation Using Voltage-Controlled g-Tensor Modulation", Y. Kato, R. C. Myers, D. C. Driscoll, A. C. Gossard, J. Levy, D. D. Awschalom, Science 299, 1201 (2003)

Figure 9:
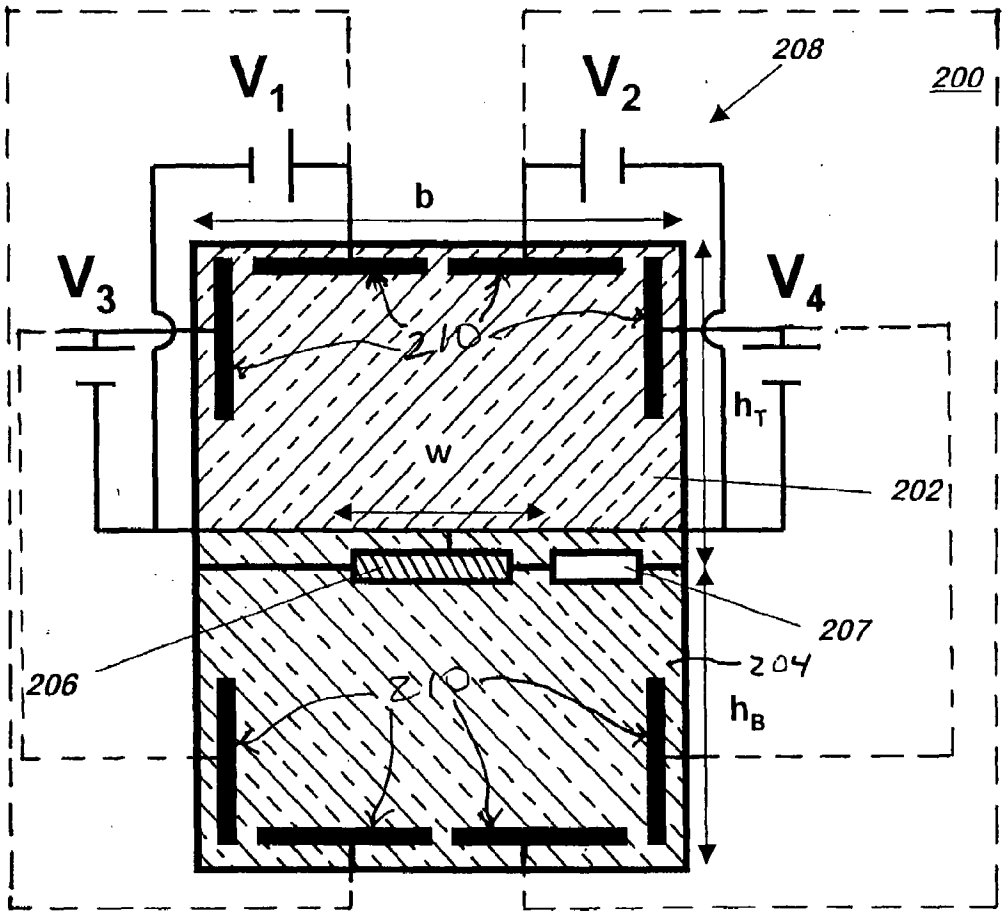
FIG. 9 is a cross-sectional diagram of a bi-crystal heterostructure using ferroelectric crystal materials and biasing circuits according to the invention.

In another embodiment of the invention, ferroelectric crystals are utilized. Referring now to FIG. 9, a bi-crystal heterostructure 200 includes ferroelectric crystal layers 202 and 204 with a guiding conductive metal strip 206 inserted there between. Exemplary ferroelectric materials useful in the invention are described in *Encyclopedia of Science and Technology*, McGraw-Hill, 9$^{th}$ Ed., Vol. 7, pp. 62–66 (2002). Crystalline substances which have a permanent spontaneous electric polarization (electric dipole moment per cumic centimeter) that can be reversed by an electric field are ferroelectrics. From a practical standpoint, ferroelectrics are divided into two classes. In the first class, spontaneous polarization can occur only along one crystal axis. That is, the ferroelectric axis is already a unique axis when the material is in the paraelectric phase. Typical representatives of this class are Rochelle salt, $KH_2PO_4$, $(NH_4)_2SO_4$, guanidine aluminum sulfate hexahydrate, glycine sulfate, colemanite, and thiourea. For the second class, spontaneous polarization can occur along several axes that are equivalent in the paraelectric phase. The following substances, that are all cubic when above the Curie point, belong to this class: the $BaTiO_3$-type (or perovskite-type) ferroelectrics; $Cd_2Nb_2O_7$, $PbNb_2O_6$; certain alums such as methyl ammonium alum; and $(NH_4)_2Cd_3(SO_4)_3$. Some of the $BaTiO_3$-type ferroelectrics have, below the Curie temperature, additional transition temperatures at which the spontaneous polarization switches from one crystal axis to another crystal axis. For example, $BaTiO_3$ and $KNbO_3$ polarize with decreasing temperature first along a [100] axis then the polarization switches into a [110] axis and finally into a [111] axis. Accordingly, suitable ferroelectric crystal materials may include either isotropic or anisotropic ferrolectric materials that function in this manner. Suitable ferroelectric crystals include the above materials and also various stoichiometric ratios of the atomic elements in barium strontium titanate and lanthanum aluminate. For example, layers 202 and/or 204 may consist of the ferroelectric $Ba_xSr_{1-x}TiO_3$ and $Pb_xZr_{1-x}TiO_3$, where x can vary from 0 to 1; $LaAlO_3$, or another suitable ferroelectric material. As with the above description regarding heterostructure 100, a lossy strip 207 is positioned alongside conductive strip 206. A static electric bias field $E_0$ is applied across layer 202, by bias circuit 208 as shown to contacts 210, in a strength sufficient to obtain a desired reduction in permittivity in the bias direction. It is noted that FIG. 9 shows the biasing circuit for the top crystal 202; leads extending to contacts 210 (also embedded in layer 204) are shown in phantom, because optionally, should a higher degree of bias control be desired, one or more of contacts 210 in layer 204 may each be associated with its own independent bias voltage source (not illustrated). These, as with $V_1$–$V_4$, may be pre-set at predetermined design voltages or alternatively may be variable. In any event, voltages $V_1$–$V_4$ impart the requisite anisotropic rotation-imparting uniaxiality for layer 204 that is opposite that of layer 202. The voltages $V_1$–$V_4$ may be selected so as to impart a desired amount of reduction in permittivity in the bias direction, and in this manner heterostructure 200 becomes a variable control component with user-controlled variable asymmetry. The artificially induced preferred direction becomes the extraordinary direction and is a principal axis direction. Permittivity tensor element in that direction is the extraordinary permittivity diagonal value $\epsilon_e$. Two other principal axis directions, normal to this preferred biased direction, become the ordinary directions and in those directions is the unbiased original permittivity, equal to the ordinary permittivity $\epsilon_o$. Accordingly, heterostructure 200 operates in the same manner as heterostructure 100 with its lossy strip 207 absorbing signal energy for signals in the z direction while propagating signals in the −z direction.

The ferroelectric behavior of permittivity change is based upon a phase transition, going from a cubic to tetragonal atomic crystalline arrangement, which takes the crystal from a paraelectric state to a ferreoelectric state. This is why ferroelectric materials are so attractive for electronic applications, because huge percentage changes in the dielectric constant may be made. For example, it is typical to be able to obtain, at proper temperatures, nominal values of permittivity being 2000, 500, or 140, and being able to get final values of 400, 250, and 100, These dielectric constant final values correspond to 5:1, 2:1 and to 29% changes using suitable bias electric field $E_0$ values.

An advantage of a ferroelectric crystalline system is that by varying the bias voltage, that is, by implementing biasing configurations dc isolated from the rf characteristics of the electromagnetic structure, variable asymmetry can be achieved, with the tremendous quality of being a variable control component. It creates what is termed a negative crystal such as described in J. F. Nye, *Physical Properties of Crystals*, (Oxford University Press, Oxford, 1979. First published 1957), because the extraordinary permittivity value is deflated compared to the ordinary permittivity value.

Bi-crystal layering which produces the effect has two adjacent layers 202 and 204 with opposite rotations of the principal cross-sectional axes, the rotation angles denoted by θ, where the positive angle corresponds to a counter-clockwise rotation of the cross-sectional xy axes about the z-axis. Electromagnetic waves propagate down the z-axis (the axis coming out of the page), the longitudinal axis of the uniform guiding structure. To utilize the negative refractive property, the guiding metal 206 is placed between the two crystals. In such an arrangement, crystal layer 204 is the bottom substrate, the other crystal layer 202 the superstrate on top. The tensor of an unrotated, principal axis system crystal, is given by the dyadic $\bar{\bar{\epsilon}}=\epsilon_{xx}\hat{x}\hat{x}+\epsilon_{yy}\hat{y}\hat{y}+\epsilon_{zz}\hat{z}\hat{z}$. Rotation of the bottom crystal about the z-axis in the $\theta=\theta_b$ amount creates off diagonal elements equal to $\epsilon_{rxy}=\epsilon_{ryx}=(\epsilon_{yy}-\epsilon_{xx})\sin 2\theta_b/2$ with the last dyadic term unchanged [1], [4]. All other off-diagonal elements remain zero. Diagonal elements become $\epsilon_{rxx}=(\epsilon_{xx}\cos^2\theta_b+\epsilon_{yy}\sin^2\theta_b)$ and $\epsilon_{ryy}=(\epsilon_{xx}\sin^2\theta_b+\epsilon_{yy}\cos^2\theta_b)$. Rotation of the top crystal about the z-axis in the $\theta=\theta_t$ amount creates off-diagonal elements equal to $\epsilon_{rxy}=\epsilon_{ryx}=(\epsilon_{yy}-\epsilon_{xx})\sin^2\theta_t/2$ with the last dyadic term unchanged. All other off-diagonal elements remain zero. Diagonal elements become $\epsilon_{rxx}=(\epsilon_{xx}\cos^2\theta_t+\epsilon_{yy}\sin^2\theta_t)$ and $\epsilon_{ryy}=(\epsilon_{xx}\sin^2\theta_t+\epsilon_{yy}\cos^2\theta_t)$.

The off-diagonal elements are maximized in the individual layers when $\sin 2\theta=1$. This occurs for $\theta=\pm 45$. Increasing the angle still further, up to $\theta=\pm 90$, however, supposing $\theta_b=90$ and $\theta_t=-90$, causes the incommensurate marking off of atomic layers to vanish, making symmetry appear again (looks like the unrotated case again). Generally one expects $\theta_b-\theta_t=\pm 90$ to produce the maximum effect.

There are only two possibilities for picking out the beginning unrotated principal axis system uniaxial tenors. Dyadics must be either $\bar{\bar{\epsilon}}=\epsilon_e\hat{x}\hat{x}+\epsilon_o\hat{y}\hat{y}+\epsilon_o\hat{z}\hat{z}$ or $\bar{\bar{\epsilon}}=\epsilon_o\hat{x}\hat{x}+\epsilon_e\hat{y}\hat{y}+\epsilon_o\hat{z}\hat{z}$ because there are only two ways to insert the single extraordinary axis permittivity into the 2×2 submatrix, also forcing the last diagonal element to be the ordinary value. We choose the first case.

If $\theta=\pm 45$ is selected, with $\theta_b=45$ and $\theta_t=-45$, $\sin^2\theta=\cos^2\theta$ making diagomal elements $\epsilon_{rxx}=\epsilon_{ryy}=(\epsilon_{xx}+\epsilon_{yy})/2=\epsilon_a$, an averaged value of the first two principal axis diagonal elements. It must be $\epsilon_a=(\epsilon_e+\epsilon_o)/2$. Off-diagonal elements are $\epsilon_{rxy}=\epsilon_{ryx}=\pm(\epsilon_{yy}-\epsilon_{xx})/2=\pm\epsilon_d$ with $\theta>0$ or $\theta<0$ for the plus or minus signs on $\epsilon_d$. So $\epsilon_d=(\epsilon_o-\epsilon_e)/2$ for a negative crystal.

Although devices 100 and 200 are shown with symmetric geometric placement of the crystal layers with respect to all the bounding walls, it should be understood that each crystal layer can be of unequal thickness, causing the field to be unsymmetric in the vertical direction. Cross-hatching is meant to show the crystalline planes, and the normal to them indicates a principal axis direction for each one of the crystals. Strip thickness is taken to be vanishing small.

Figure 10:
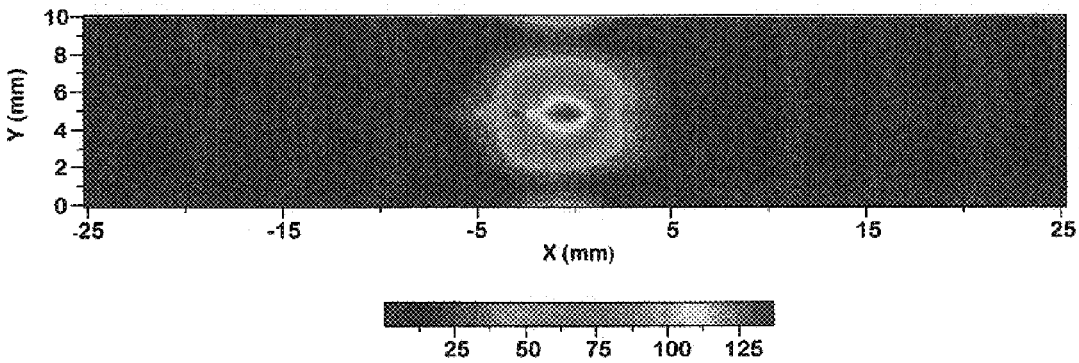
FIG. 10 shows the electric field distribution for the heterostructure of FIG. 9 for a nominal permittivity of 30.

In the simulated calculations that follow, $w=h_T=h_B=5$ mm, b=50 mm, making $h_{TOTAL}=h_T+h_B=10$ mm. b/w=10. Starting with the structure in FIG. 9, computations were run for nominal values of the permittivity $\epsilon=500$, 140, and 30. FIG. 10 shows the electromagnetic field distribution for the transverse electric field $E_t$ in the cross-section. $H_t$ is similar and won't be shown here due to space limitations. Frequency was f=10 GHz and the propagation constant pure phase with $\gamma=\alpha+j\beta=j\beta$, $\beta=4.392$ normalized to the free space value. Number of even and odd current basis functions was $n_x=n_z=1$ for currents in the x and z directions. Both parities of the basis functions is needed to allow for asymmetric current distributions in the x direction. Number of spectral terms was n=200. Permittivity values were $\epsilon_e=15$ and $\epsilon_o=30$, making $\epsilon_a=22.5$ and $\epsilon_d=7.5$. $\epsilon_d/\epsilon_a=33\%$. Distribution is FIG. 10 seems to be a fundamental mode fixed about the strip, with a cycloid shape, and the major intensity of the distribution shifted to the left. (Strip located at $|x|\leqq 2.5$ mm or $-2.5\leqq x\leqq 2.5$.)

Figure 11:
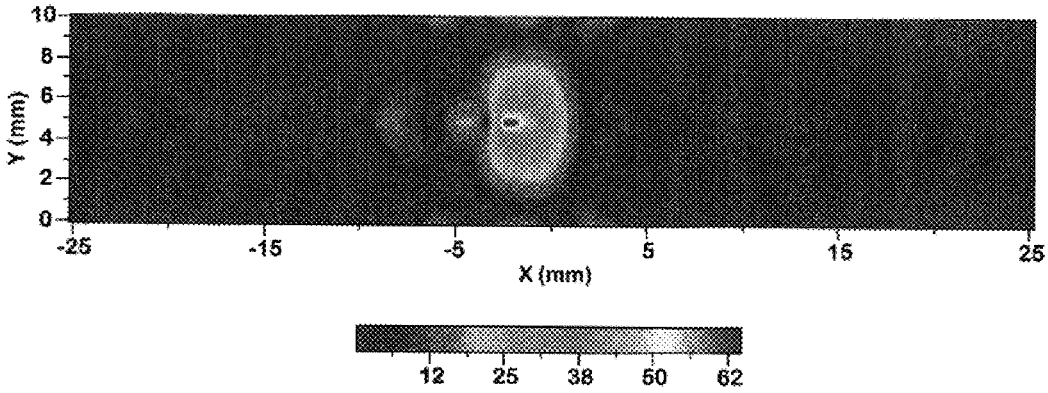
FIG. 11 shows shows the electric field distribution for the heterostructure of FIG. 9 for a nominal permittivity of 140.

FIG. 11 shows the transverse electric field $E_t$ for f=10 GHz. Permittivity values were $\epsilon_e=110$ and $\epsilon_o=140$, making $\epsilon_a=125$ and $\epsilon_d=15$. $\epsilon_d/\epsilon_a=12\%$. Distribution in FIG. 11 also seems to be a fundamental mode but with less of a pronounced cycloid shape than before. Overall intensity of the entire distribution is even more shifted to the left. Again the propagation constant is pure phase with $\beta=10.38$ normalized to the free space value.

Figure 12:
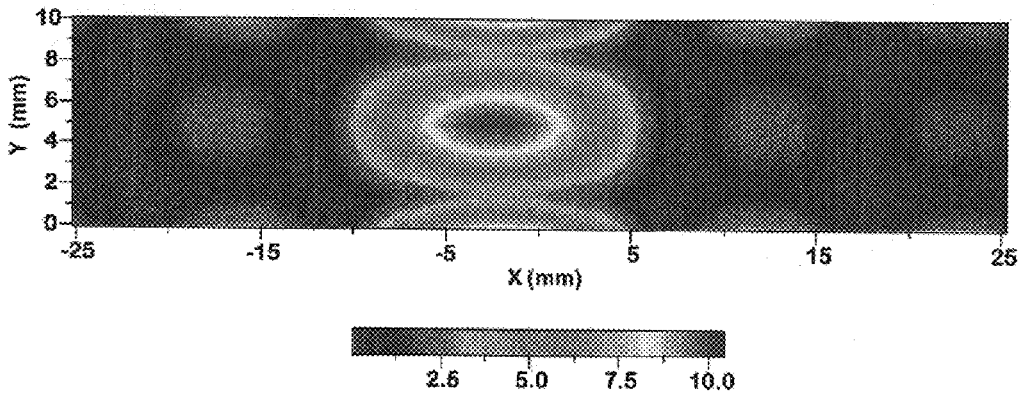
FIG. 12 shows the electric field distribution for the heterostructure of FIG. 9 for a nominal permittivity of 500.
Figure 13:
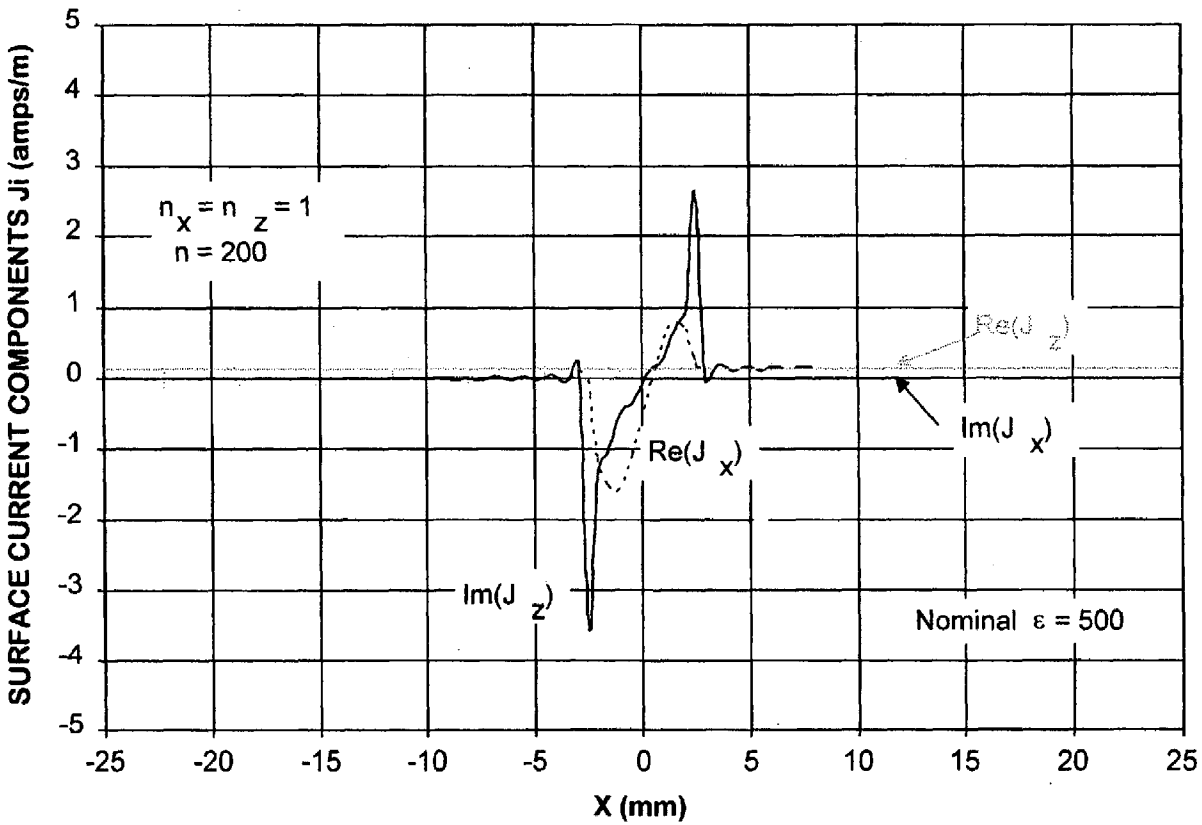
FIG. 13 is a graph showing the surface current distribution corresponding to FIG. 12.

Lastly, FIG. 12 shows the transverse electric field $E_t$ for f=2 GHz. Permittivity values were $\epsilon_e=250$ and $\epsilon_o=500$, making $\epsilon_a=375$ and $\epsilon_d=125$. $\epsilon_d/\epsilon_a=33\%$. Distribution in FIG. 12 seems to be a fundamental mode, or at least one that is close to being the fundamental, as the majority of the distribution's highest strength is located about the strip. Elliptical distribution shapes appear. Marked shift of the overall distribution to the left is apparent. Again the propagation constant is pure phase with $\beta=17.888$ normalized to the free space value. As above-described regarding the device illustrated in FIG. 2, all the calculations were performed using an anisotropic Green's function spectral domain method. The surface current distribution corresponding to FIG. 120-12 is shown in FIG. 13.

Isolator action can be enabled by taking advantage of the asymmetric electromagnetic field distribution by inserting a lossy strip, a second strip, beside the symmetrically located guiding strip, so that it is off—centered and positioned correctly so as to attenuate the wave when the direction is reversed from the low loss direction. This concept is well known, and is referred to as the field displacement effect, as previously described and shown in FIG. 2.

It should be noted that there is an advantage to using ferroelectric materials, in that even for the situation where one has amorphous material with random micro—crystal orientations, imposition of a biasing field may allow artificial creation of the principal axes, a requirement for getting the bi-crystal to exist. It may be desirable to actively sense whether the wave enters from port 1 (into the page for FIG. 9 and from the left for FIG. 14) or port 2 (out of the page and from the right, respectively, for FIGS. 9 and 14) and electronically bias the ferroelectric crystals to shift the rf field magnitude to be low loss or high loss with regard to the lossy strip.

Regarding heterostructures 100 and 200, it should be understood that layers 102 and 202, and 104 and 204, are fully interchangeable and may be used in any desired configuration that obtains the requisite negative refraction. For example, layer 102 could be used with layer 204 and the latter's biasing circuit to establish the relative rotations described above.

Figure 14:
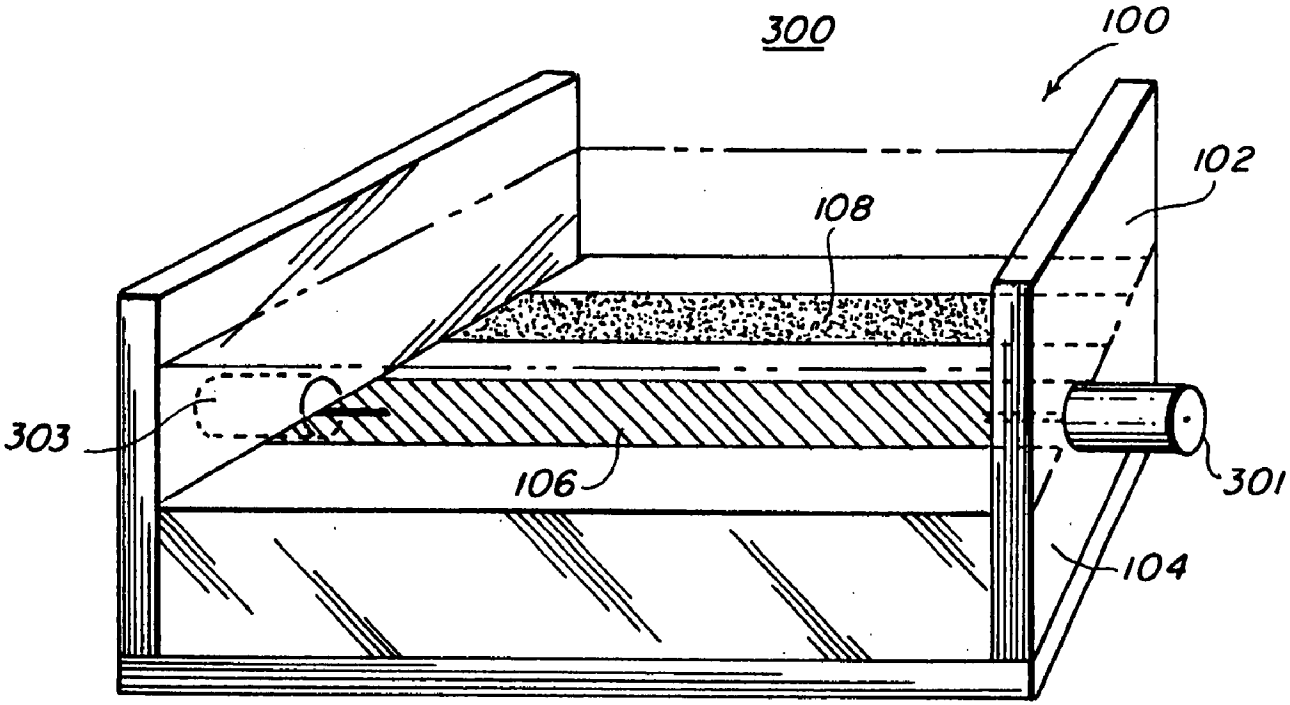
FIG. 14 is a perspective view, partially cut away to show structural details, of an electronic isolator according to the invention.

Referring now to FIG. 14, an electrical isolator 300 includes one of the bi-crystal heterostructures described above in relation to FIGS. 2 and 9, which for convenience of illustration is shown using the heterostructure of FIG. 2, although it should be understood that corresponding structural components conforming to the above descriptions must be substituted and biasing circuit 208 included. Connectors 301 and 303 are at opposite ends of conductive metal strip 106.

Figure 15:
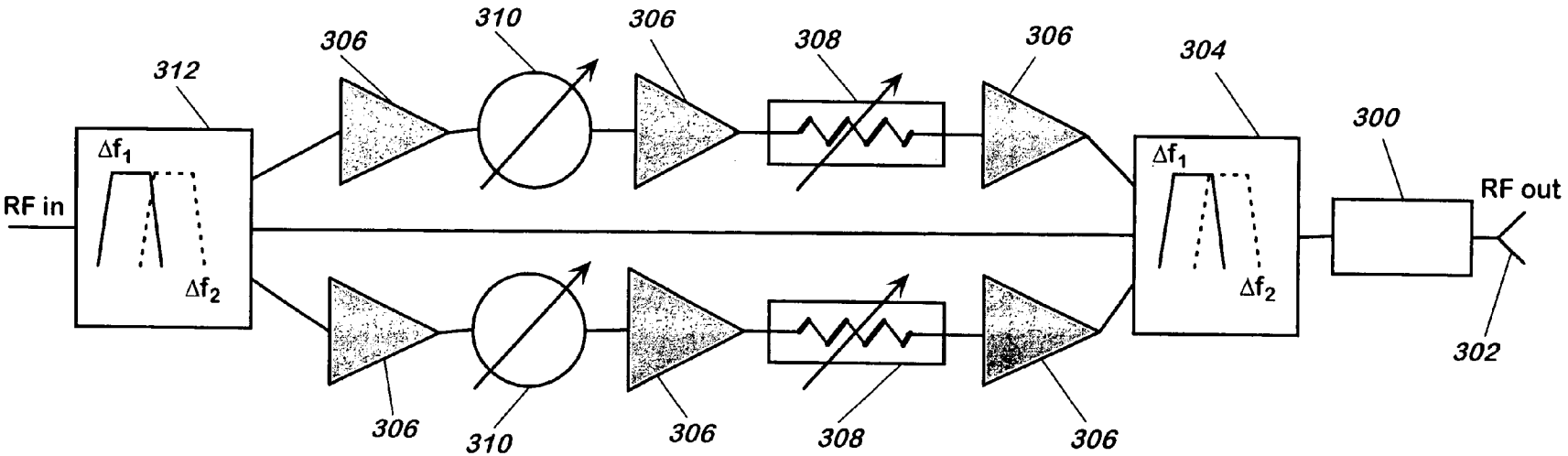
FIG. 15 is a schematic diagram of an RF transmitter circuit that includes an electronic isolator according to the invention.

FIG. 15 illustrates a representative RF transmitting system 400 that includes an isolator 300 connected between an antenna 302 and a diplexer 304. Amplifiers 306 are connected as shown, along with variable attenuators 308 and variable phase shifters 310, between diplexer 304 and a second diplexer 312. Isolator 300 is connected is described above in regard to FIG. 13 such that rf signals are preferentially transmitted toward the antenna while blocking signals entering the antenna from traversing system 400 up-signal path of isolator 300. An rf signal at a frequency f is input to a diplexer 312 having bandwidths $\Delta f_1$ and $\Delta f_2$ centered about $f_1$ and $f_2$. The isolator with allow signals flowing from left to right, from the RF input signal going through the input diplexer 312, into amplifiers 306 and phase shifters 310 and variable attenuators 308, and final output diplexer 304 for transmitting, to pass unobstructed to an antenna 302. However, unwanted received signals, which could damage or jam the transmitter, are blocked by the action of the isolator 300.

Structures 100, 200, and 300 may be used as described above in a microwave system, and also may be used in an optical system (not illustrated) to provide multiplexing capability based upon movement of the energy signal focus. This may be especially apparent in an optical system where the beam focus may be shifted by the asymmetric field effect. It may also be possible in the optical case, that an optical isolator also may be constructed by having the beam shifted for one propagation direction as in the microwave device, but the shifted beam may simply be shunted or directed elsewhere in the other propagation direction, in contrast to the microwave device where the shifted signal is absorbed by a lossy material deposited onto the crystal, such as a chromium-chromium oxide.

Obviously many modifications and variations of the present invention are possible in the light of the above teachings. It is therefore to be understood that the scope of the invention should be determined by referring to the following appended claims.

I claim:

1. A bi-crystal heterostructure, comprising:

a first, substantially uniaxial, crystal layer;

a second, substantially uniaxial, crystal layer positioned adjacent to said first crystal layer, and wherein said first and second crystal layers have mutually opposite rotations of their respective principal cross-sectional axes of a degree sufficient to impart negative refractivity in said heterostructure;

a conductive metal strip positioned between said crystal layers and having a principal longitudinal axis sufficiently aligned with an unrotated principal axis of each of said first and second crystal layers to permit unidirectional electromagnetic wave propagation in said conductive metal strip; and a lossy metal strip positioned between said crystal layers and having a principal axis positioned substantially parallel to said principal axis of said conductive metal strip.

2. A heterostructure as in claim 1, wherein each of said crystal layers is selected from the group consisting of $LiNbO_3$ and $YVO_4$.

3. An electrical isolator as in claim 1, wherein each of said crystal layers is selected from the group consisting of $LiNbO_3$ and $YVO_4$.

4. An electrical isolator, comprising:

a first, substantially uniaxial, crystal layer;

a second, substantially uniaxial, crystal layer positioned adjacent to said first crystal layer, and wherein said first and second crystal layers have mutually opposite rotations of their respective principal cross-sectional axes of a degree sufficient to impart negative refractivity in said heterostructure;

a conductive metal strip positioned between said crystal layers and having a principal longitudinal axis sufficiently aligned with an unrotated principal axis of each of said first and second crystal layers to permit unidirectional electromagnetic wave propagation in said conductive metal strip;

a lossy metal strip positioned between said crystal layers and having a principal axis positioned substantially parallel to said principal axis of said conductive metal strip; and a first electrical connector at a first end of the conductive metal strip and a second electrical connector at a second end of the conductive metal strip.

5. An electrical isolator as in claim 4, wherein the isolator is positioned in an rf transmitter circuit whereby rf signals are substantially blocked in one direction and transmitted in an opposite direction.

6. An electrical isolator as in claim 5, wherein each of said crystal layers is selected from the group consisting of $LiNbO_3$ and $YVO_4$.

7. A crystal heterostructure electrically biased for imparting a uniaxial property, comprising:

a first, substantially ferroelectric crystal layer;

a second, substantially ferroelectric crystal layer positioned adjacent to said first crystal layer;

a conductive metal strip positioned between said crystal layers and having a principal longitudinal axis sufficiently aligned with an unrotated principal axis of each of said first and second crystal layers to permit unidirectional electromagnetic wave propagation in said conductive metal strip;

a lossy metal strip positioned between said crystal layers and having a principal axis positioned substantially parallel to said principal axis of said conductive metal strip; and a static bias voltage source connected to and applied across each of said crystal layers for imparting the uniaxial property to said crystal layers whereby said crystal layers have mutually opposite rotations of their respective principal cross-sectional axes of a degree sufficient to impart negative refractivity in said heterostructure.

8. A heterostructure as in claim 7, further comprising a plurality of variable bias voltage sources connected to each of said crystal layers.

9. A heterostructure as in claim 7, wherein each of said crystal layers is selected from the group consisting of $BaTiO_3$, $Cd_2Nb_2O_7$, $PbNb_2O_6$, an alum, $(NH_4)_2Cd_3(SO_4)_3$, $KNbO_3$, and $LaAlO_3$.

10. A heterostructure as in claim 9, wherein each of said crystal layers is selected from the group consisting of methyl ammonium alum, $Ba_xSr_{1-x}TiO_3$, where x can vary from 0 to 1, and $Pb_xZr_{1-x}TiO_3$, where x can vary from 0 to 1.

11. A heterostructure as in claim 7, further comprising a first electrical connector at a first end of the conductive metal strip and a second electrical connector at a second end of the conductive metal strip.

12. A heterostructure as in claim 11, wherein the heterostructure is positioned in an rf transmitter circuit whereby rf signals are substantially blocked in one direction and transmitted in an opposite direction.

13. A heterostructure as in claim 12, wherein each of said crystal layers is selected from the group consisting of $BaTiO_3$, $Cd_2Nb_2O_7$, $PbNb_2O_6$, an alum, $(NH_4)_2Cd_3(SO_4)_3$, $KNbO_3$, and $LaAlO_3$.

14. A heterostructure as in claim 13, wherein each of said crystal layers is selected from the group consisting of methyl ammonium alum, $Ba_xSr_{1-x}TiO_3$, where x can vary from 0 to 1, and $Pb_xZr_{1-x}TiO_3$, where x can vary from 0 to 1.

15. A heterostructure as in claim 14, further comprising a plurality of variable bias voltage sources connected to each of said crystal layers.

16. A bi-crystal heterostructure electrically biased for imparting a uniaxial property, comprising:

a first, substantially uniaxial, crystal layer;

a second, substantially ferroelectric crystal layer;

a conductive metal strip positioned between said crystal layers and having a principal longitudinal axis sufficiently aligned with an unrotated principal axis of each of said first and second crystal layers to permit unidirectional electromagnetic wave propagation in said conductive metal strip;

a lossy metal strip positioned between said crystal layers and having a principal axis positioned substantially parallel to said principal axis of said conductive metal strip; and a static bias voltage source connected to and applied across said second crystal layer for imparting the uniaxial property to said second crystal whereby said first and second crystal layers have mutually opposite rotations of their respective principal cross-sectional axes of a degree sufficient to impart negative refractivity in said heterostructure.

17. A heterostructure as in claim 16, further comprising a plurality of variable bias voltage sources connected to said second crystal layer.

18. A heterostructure as in claim 16, further comprising a first electrical connector at a first end of the conductive metal strip and a second electrical connector at a second end of the conductive metal strip.

19. A heterostructure as in claim 18, wherein the heterostructure is positioned in an rf transmitter circuit whereby rf signals are substantially blocked in one direction and transmitted in an opposite direction.

20. A heterostructure as in claim 19, wherein said first crystal layer is selected from the group consisting of $LiNbO_3$ and $YVO_4$ and said second crystal layer is selected from the group consisting of $BaTiO_3$, $Cd_2Nb_2O_7$, $PbNb_2O_6$, an alum, $(NH_4)_2Cd_3(SO_4)_3$, $KNbO_3$, and $LaAlO_3$.

21. A heterostructure as in claim 20, wherein said second crystal layer is selected from the group consisting of methyl ammonium alum, $Ba_xSr_{1-x}TiO_3$, where x can vary from 0 to 1, and $Pb_xZr_{1-x}TiO_3$, where x can vary from 0 to 1.

22. A heterostructure as in claim 21, further comprising a plurality of variable bias voltage sources connected to said second crystal layer.

* * * * *